United States Patent [19]

Schnebly

[11] 4,425,950

[45] Jan. 17, 1984

[54] LOG SPLITTING APPARATUS

[76] Inventor: Eugene L. Schnebly, 18508 Road 14, Fredericktown, Ohio 43019

[21] Appl. No.: 406,114

[22] Filed: Aug. 6, 1982

[51] Int. Cl.[3] ..... B27L 7/00

[52] U.S. Cl. ..... 144/194; 144/193 R

[58] Field of Search ..... 144/193 R, 193 D, 194

[56] References Cited

U.S. PATENT DOCUMENTS

| | | | |
|---|---|---|---|
| 3,670,789 | 6/1972 | Long | 144/194 X |
| 3,993,113 | 11/1976 | Thackery | 144/194 |
| 4,027,709 | 6/1977 | Thackery | 144/193 R |
| 4,091,851 | 5/1978 | Ober | 144/193 R |
| 4,132,255 | 1/1979 | Thackery | 144/194 X |
| 4,211,265 | 7/1980 | Thackery | 144/194 |
| 4,315,534 | 2/1982 | Blackston | 144/194 |
| 4,335,762 | 6/1982 | Reaume et al. | 144/194 |
| 4,347,881 | 9/1982 | Wickham et al. | 144/194 |

FOREIGN PATENT DOCUMENTS

| | | | |
|---|---|---|---|
| 1602790 | 11/1981 | United Kingdom | 144/194 |

*Primary Examiner*—W. D. Bray

*Attorney, Agent, or Firm*—McCaleb, Lucas & Brugman

[57] ABSTRACT

A log splitting apparatus is provided having a rotatably driven splitter cone extending forwardly from a housing. A horizontal stabilizer base assembly extends forwardly from the bottom of the housing. The apparatus, optionally, rests directly on the ground or indirectly on the ground through elevating blocks. The stabilizer base assembly includes a base plate at one side of the housing and a transverse torque arm extending to the other side of the housing. The base plate has a pivoted connection to the one side of the housing about an axis extending substantially parallel to that of the splitter cone and is positioned to engage a log being pierced by the splitter cone to thereby enable the base plate to absorb torque reaction at the one side of the housing. The free end of the torque arm engages a support member extending forwardly from the opposite side of the housing to absorb additional torque reaction at that opposite side, thereby tending to neutralize any twisting or lifting forces applied thereto.

6 Claims, 5 Drawing Figures

Fig. 1.
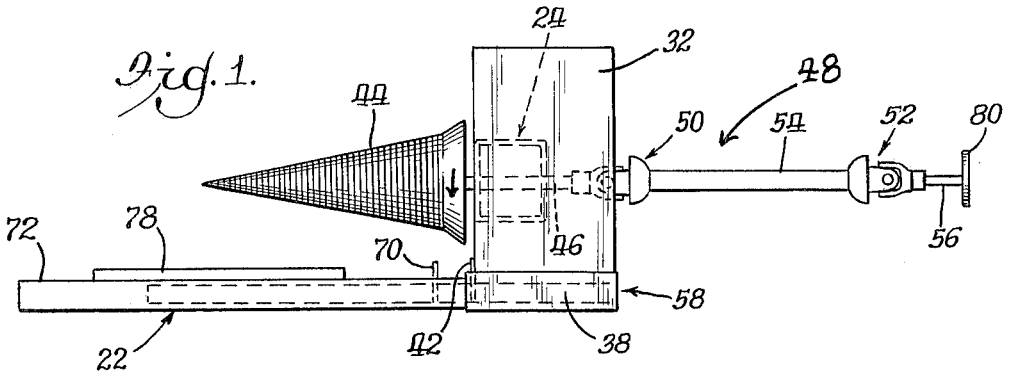
Fig. 2.
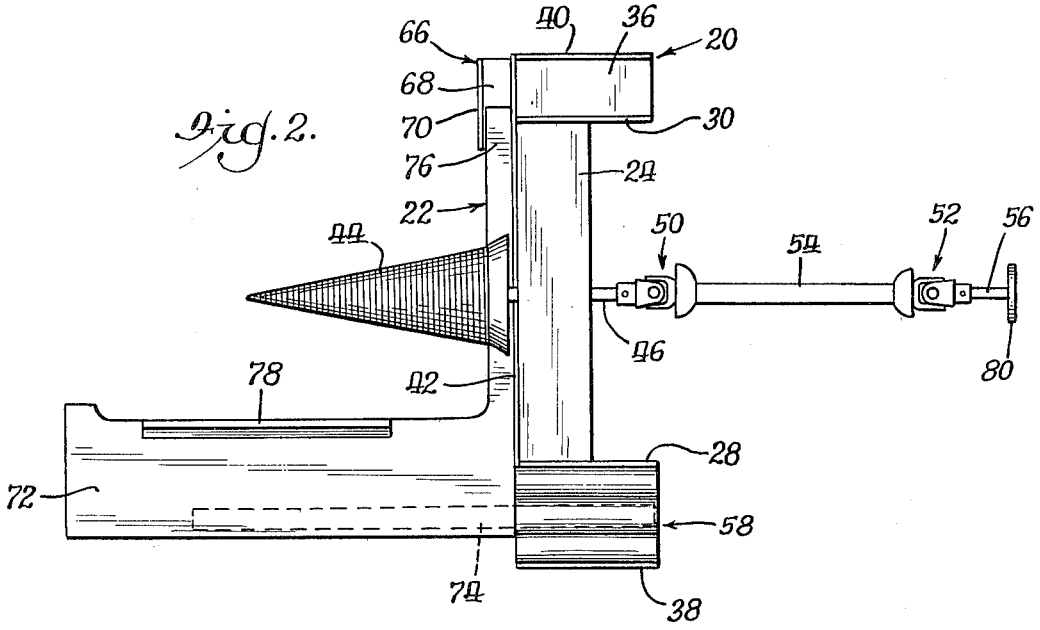
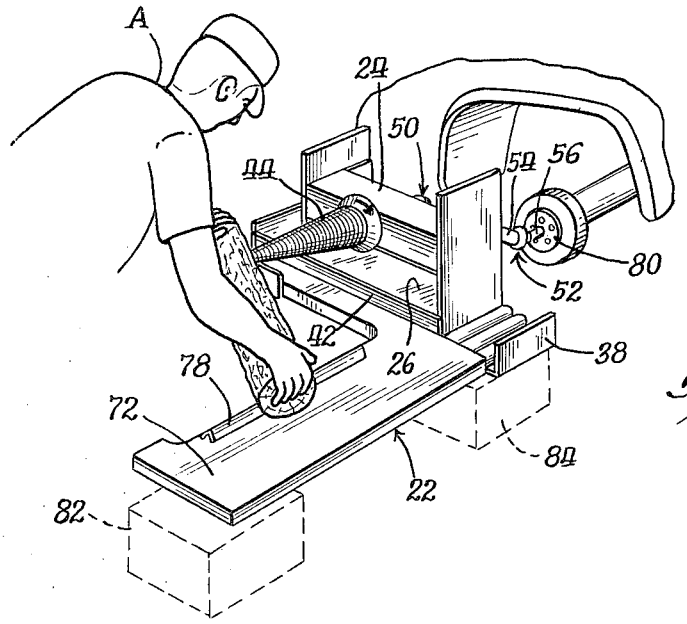
Fig. 5.

LOG SPLITTING APPARATUS

BACKGROUND OF THE INVENTION

This invention belongs generally to the field of log splitting apparatus and particularly to such apparatus utilizing a rotatably driven splitter cone.

Such apparatus typically consists of a housing in which a forwardly extending, externally threaded splitter cone is rotatably journaled. At the rear end of the housing, there is a connector plate or flexible drive shaft to rotatably drive the splitter cone from the hub of a jacked-up vehicle wheel or from the power take off at the rear of a tractor.

A serious problem encountered with such apparatus is the torque reaction applied by the rotating cone to the log being split. The operator may try to counteract this torque reaction by splitting the log near one end and resting the opposite end on the ground, or against a brace member extending forwardly from the housing. Despite such precautions, the torque reaction can lift the housing and cause a stuck log to spin with the cone, creating a very dangerous condition for the operator, and over-stressing or damaging the three-point hitch ordinarily provided with a tractor power take off. Attempts have even been made to stabilize the housing by providing vertical stabilizer bars journaled in opposite sides of the housing, and driving them into the ground before splitting logs. This is not entirely satisfactory or completely safe because it does not work at all on concrete or hard earth and, further, the stabilizer bars will loosen in use and pull out of soft earth and must be reset from time to time. This situation is accordingly in need of improvement.

SUMMARY OF THE INVENTION

Therefore, a principal object of the present invention is to provide a splitter cone type log splitting apparatus having a stabilizer base assembly, engageable by a log being pierced, which will positively prevent torque reaction from either lifting or rotating the housing in use.

Another object is to provide such apparatus in which the stabilizer base assembly is pivotally connected about a fixed axis at one side of the housing to transfer torque reaction from the log into that one side of the housing.

Another object is to provide such apparatus in which the pivotally mounted stabilizer base assembly has a transverse torque arm engageable with a support member at the opposite side of the housing to transfer additional torque reaction from the log into that opposite side of the housing and thereby tend to neutralize any overall rotating effect on the housing.

Another object is to provide such apparatus in which the stabilizer base assembly is connected to the housing at a definite, fixed distance from the axis of the splitter cone so it is impossible to create a condition hazardous to the operator as a result of a log displacing the stabilizer base assembly downwardly from the splitter cone and causing the housing to lift from the ground, or a stuck log from flailing with the cone, or both.

BRIEF DESCRIPTION OF THE DRAWINGS

Other objects and advantages will be apparent from the following description taken in connection with the drawings in which:

FIG. 1 is a side elevational view of a preferred embodiment of the invention;

FIG. 2 is a top plan view of FIG. 1;

FIG. 5 is a perspective view of the apparatus showing it in use.

Like parts are referred to by like reference characters.

DESCRIPTION OF THE PREFERRED EMBODIMENT

Figure 4:
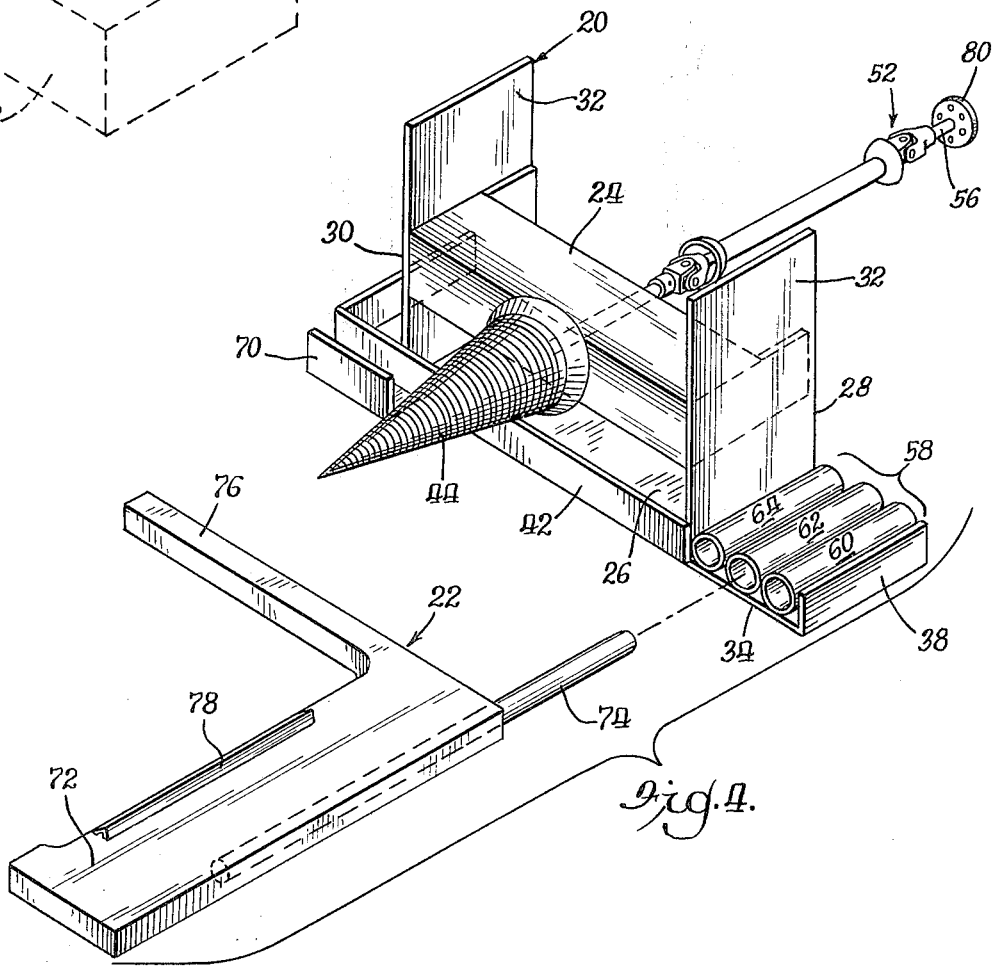
FIG. 4 is an exploded view of FIG. 3.

Referring now to the specific embodiment of the invention shown in the drawings, the log splitting apparatus comprises a housing portion 20 and a stabilizer base assembly 22 which are separately shown in FIG. 4.

The housing portion consists of a horizontal box frame member 24 and a horizontal bottom plate 26 fastened as by welding between a pair of rectangular shaped vertical side plates 28 and 30. In the embodiment shown, the side plates have upper extensions 32 to facilitate attachment of a conventional tractor three point hitch if desired. The bottom plate has end sections 34 and 36 extending beyond sidewalls 28 and 30. Vertical end flanges 38 and 40 are provided at the ends of the bottom plate. A vertical front flange 42 extends along the front edge of the bottom plate to stiffen it and this may be fastened as be welding along the front edges of the side plates to further rigidify the housing structure. A splitter cone 44 of conventional construction is mounted at the forward end of a shank 46 which is rotatably journaled within the frame member 24. At its rear end, the shank 46 is connected through a drive shaft assembly 48 to a suitable source of power which could be a jacked-up vehicle wheel or the power take off of a tractor. The drive shaft assembly includes universal joints 50 and 52 and a drive shaft 54. A take off shaft 56 may be connected (by means not shown) to the power take off of a tractor. Alternatively, shaft 56 may have a connecting disk 80 which may be bolted to the hub of a jacked-up vehicle wheel in a manner which is well known in the art and is shown in FIG. 5.

A sleeve assembly 58 consists of a plurality (in this case, three) of individual, horizontal tubes 60, 62 and 64 welded together along abutting surfaces and welded onto the end section 34 of the bottom plate.

At the opposite side of the housing, an upwardly open supporting stirrup member 66 is provided. This consists of an angle member with a horizontal web 68 and a vertical flange 70 spaced forwardly from the vertical front flange 42. It may be connected as by welding to function as a rigid component of the housing.

The stabilizer base assembly 22 comprises a generally rectangular horizontal stabilizer base plate 72, a longitudinal pivot shaft 74 affixed as by welding into the end of the base plate, and a transversely extending torque arm 76. A small steel angle member 78 is affixed as by welding to the left edge of the base plate to provide a slightly elevated log rest.

Figure 3:
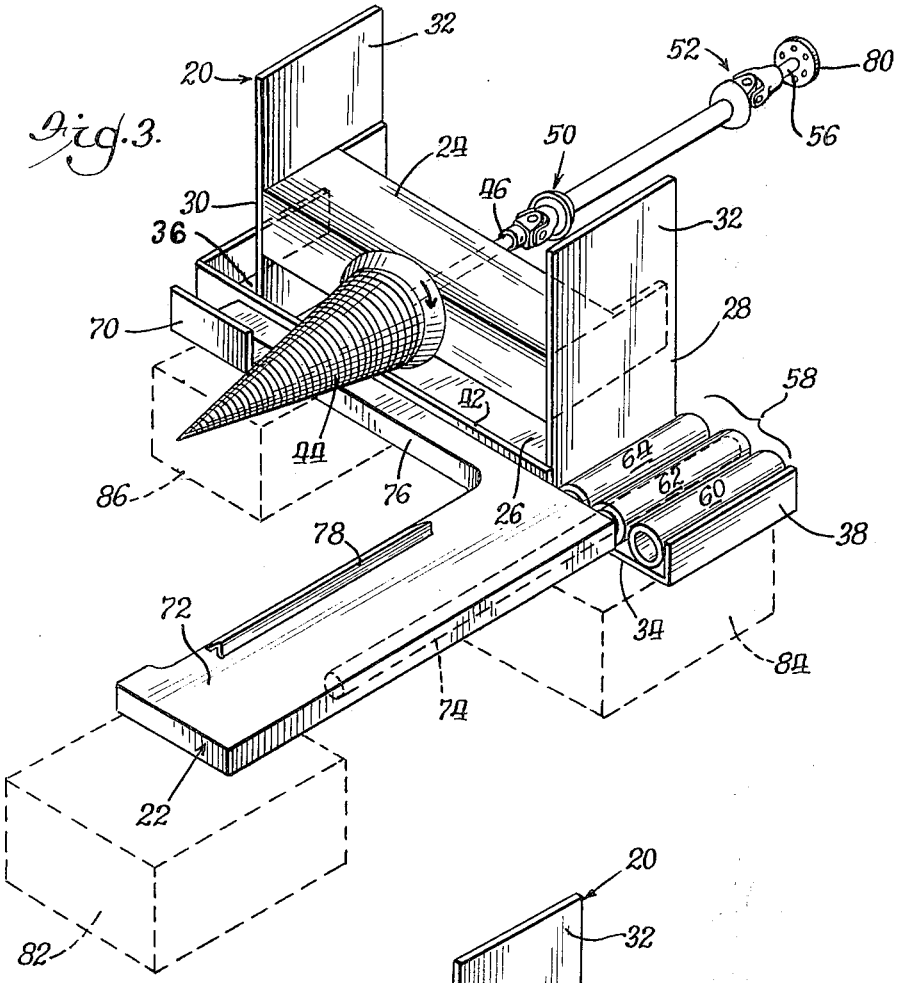
FIG. 3 is a perspective view of FIG. 1.

When assembled, as shown in FIG. 3, the pivot shaft 74 fits within one or the other of the tubular sleeves 60, 62 and 64, and the end of torque arm 76 rests within the stirrup member 66.

An important feature of the invention is that the stabilizer base assembly 22 may be positioned at different, fixed distances from the splitter cone 44 to accommodate splitting of different sized logs. In the drawings, the stabilizer base assembly 22 is shown with its shaft 74 fitted into intermediate sleeve 62. For larger or smaller log sizes, the shaft 74 may be fitted within sleeves 60 or 64. While the sleeve assembly 58 shown here comprises only three sleeves, any number may be used according to the degree of horizontal adjustability desired for the stabilizer base assembly.

Another important feature of the invention is the ease with which the base assembly portion 22 may be assembled to or disassembled from the housing portion 20. Assembly is simply a matter of inserting the pivot shaft 74 within a selected one of the sleeves in assembly 58 and then dropping the torque arm 76 into the stirrup 66. As long as the arm 76 remains in the stirrup the stabilizer base assembly 22 remains positively in place. To disassemble it, for relocation, the base assembly 22 need only be rotated sufficiently to lift the extension 76 from the stirrup and then the shaft 74 can readily be withdrawn by moving it forwardly to the position shown in FIG. 4.

Use and operation of the apparatus is believed to be apparent in view of the above description. Briefly however, as best shown in FIG. 5, the drive shaft assembly 48 may be connected to a suitable power source such as the adapter plate 80 on the rear wheel of a truck or tractor. This rotates the cone 44 in a clockwise direction with respect to the operator as shown by the arrows in FIGS. 1, 3 and 5.

As best shown in FIGS. 3 and 5, the apparatus may be mounted on elevating blocks 82, 84 and 86 to bring it up to a convenient height for access by an operator A. The operator places one end of the log against the ridge 78 on the stabilizer base plate 72, then feeds the log onto the point of the cone 44 which threads its way into the log and splits it. Torque reaction from the splitter cone is transmitted into the ground in two ways. First, it is taken through the blocks 82 and 84 by a direct transfer of force into the stabilizer plate 72; and second, it is transmitted through block 86 by indirect force transfer through the end of torque arm 76 pressing downwardly into the stirrup 66.

In the specific embodiment illustrated, the stabilizer base assembly 22 is at the right of the operator, and the surface of the splitter cone 44 which engages the log will preferably have a left hand thread to bore its way into the log while twisting it to bear against the stabilizer base. Alternatively, it will be apparent that this arrangement may be reversed (not shown) so the stabilizer base assembly is to the left of the operator in which case the surface of the cone will preferably have a right hand thread.

While one particular example of the present invention has been shown and described, it will be apparent to those skilled in the art that changes and modifications may be made without departing from the invention in its broadest aspects. Variations can readily be devised by those skilled in the art without departing from the spirit and scope of the invention.

The embodiments of the invention in which an exclusive property or privilege is claimed are defined as follows:

1. A log splitting apparatus comprising:

a housing;

a splitter cone extending forwardly from the housing and being journaled for rotation in the housing;

means for connecting the splitter cone to a rotatable power source;

a stabilizer base assembly including an elongated base plate extending forwardly from one side of the housing in position to engage a log being pierced by the splitter cone to thereby enable the base plate to absorb torque reaction from the log at said one side of the housing, the base plate having a pivotal connection to the housing about an axis extending substantially parallel to the axis of the splitter cone, a torque arm extending transversely from the base plate to the other side of the housing; and a support member connected to said other side of the housing in position to engage the end portion of the torque arm remote from the base plate to thereby absorb additional torque reaction from the log at the other side of said housing.

2. A log splitting apparatus according to claim 1 in which the pivotal connection between the base plate and the housing is transversely adjustable to vary the spacing between the splitter cone and the base plate to accommodate different length logs.

3. A log splitting apparatus according to claim 1 in which the pivotal connection between the base plate and housing comprises a plurality of optionally selectable, transversely spaced, pivot shaft and sleeve connections.

4. A log splitting apparatus according to claim 1 in which:

the housing has two vertical side plates on opposite sides of the splitter cone, both of the side plates extending downwardly to a level below the splitter cone; and said pivotal connection comprises at least one horizontal sleeve extending parallel to the splitter cone axis and being fastened to the bottom of the side plate on said one side of the housing, and a pivot shaft extending backwardly from the base plate and being pivotally journaled within the sleeve.

5. A log splitting apparatus according to claim 1 in which:

the pivotal connection between the base plate and housing comprises a plurality of transversely spaced pivot shaft and sleeve connections optionally selectable to place the base plate in different transverse positions relative to the splitter cone to accommodate different lengths of logs; and said support member is an upwardly open stirrup supporting the torque arm in said different transverse positions of the base plate while preventing forward removal of the base plate.

6. A log splitting apparatus according to claim 5 in which the pivot shaft and sleeve connections are freely relatively movable parallel to the axis of the splitter cone, and said stirrup includes a portion preventing forward displacement of the torque arm when the latter is seated in the stirrup to thereby retain the base plate assembled to the housing when the torque arm is seated in the stirrup.

* * * * *